United States Patent [19]

Campbell et al.

[11] Patent Number: 4,744,602

[45] Date of Patent: May 17, 1988

[54] APPARATUS FOR POSITIONING A CHILD IN A HIGH-CHAIR

[76] Inventors: Thomas L. Campbell; Phyllis A. Campbell, both of 106 S. 51st Ave., Omaha, Nebr. 68132

[21] Appl. No.: 29,779

[22] Filed: Mar. 25, 1987

Related U.S. Application Data

[63] Continuation-in-part of Ser. No. 915,682, Oct. 6, 1986, abandoned.

[51] Int. Cl.[4] ..... A47C 31/00; A47C 7/50

[52] U.S. Cl. ..... 297/423; 297/284; 297/466

[58] Field of Search ..... 297/284, 312, 423, 466; 182/120

[56] References Cited

U.S. PATENT DOCUMENTS

| | | | |
|---|---|---|---|
| 1,538,538 | 5/1925 | Wood | 297/229 |
| 1,964,193 | 6/1934 | Burnett | 297/423 |
| 2,307,331 | 1/1943 | Parker, Jr. | 297/254 |
| 2,528,317 | 10/1950 | Newman et al. | 182/120 |
| 2,652,883 | 9/1953 | Holtzendorff | 297/423 |
| 2,664,150 | 12/1953 | Byrne | 297/423 |
| 2,826,246 | 3/1958 | Adams et al. | 297/466 |
| 3,167,351 | 1/1965 | Butler | 297/423 |
| 3,311,410 | 3/1967 | Hill | 297/423 |
| 3,635,526 | 1/1972 | Posey | 297/390 |
| 3,907,270 | 9/1975 | Ezzo | 297/423 |
| 4,558,903 | 12/1985 | Takagi | 297/284 |

FOREIGN PATENT DOCUMENTS

| | | | |
|---|---|---|---|
| 969883 | 5/1950 | France | 297/466 |

*Primary Examiner*—James T. McCall

*Attorney, Agent, or Firm*—Zarley, McKee, Thomte, Voorhees & Sease

[57] ABSTRACT

An adjustable child-positioning device includes an elongated cushion which is removably positioned in a high-chair. A rotatable rod mounted longitudinally through the cushion has an adjustment member affixed on each projecting end. The adjustment member includes a pair of parallel and spaced-apart pins affixed to a base, the pins adapted to straddle one of the frame members of high-chair. By rotating the adjustment member or reversing the ends of the cushion in the chain, the cushion may be located at a variety of distances from the front edge of the seat of the high-chair.

13 Claims, 3 Drawing Sheets

APPARATUS FOR POSITIONING A CHILD IN A HIGH-CHAIR

CROSS REFERENCE TO RELATED APPLICATION

This is a continuation-in-part patent application of co-pending patent application Ser. No. 915,682 filed on Oct. 6, 1986, now abandoned.

TECHNICAL FIELD

The present invention relates generally to devices for restraining a child in proper position in a high-chair and to an improved device which promotes good posture and is easily removable from the chair.

BACKGROUND OF THE INVENTION

One of the problems associated with high-chairs is the fact that a small child will easily slide out of the chair under the tray, and can fall to the floor. While "escaping" the chair is sometimes intentional on the child's part, it is frequently due to the small size of the child and the fact that the bend in the child's legs does not extend over the front edge of the seat when the child is appropriately positioned. Thus, each time the child moves or attempts to move his legs, he pulls himself forward in the seat, and begins to slide under the tray.

There are many harness-type devices known which are utilized in holding a child within a high-chair. However, conventional devices still suffer several drawbacks. One conventional type of restraint utilizes ties, belts or other fasteners which wrap around the child and tie to the frame of the high-chair, but are also cumbersome for the adult to try and fit the child into. Also, because such harnesses are fastened to the chair in a number of locations, they are not easily and quickly removable, as they require tedious unfastening from both the child and chair. Furthermore, prior art devices were not capable of easy adjustment for children of different sizes, or chairs of different sizes.

The conventional child restraints also typically have a pair of openings through which the childs legs are inserted. Such devices hold the child from sliding forward and out of the chair. However, they do little to keep a child from sliding forward out of a proper upright position while still in the chair Once the child has begun to slide forward, it is difficult for the child to reposition himself in an upright position. It is even more difficult, if not impossible, for the child to eat while in this "slouched" position.

It is therefore an object of the present invention to provide an improved device for positioning a child in a high-chair.

Another object is to provide a device which is easily removable from a high-chair.

Yet another object of the present invention is to provide a child positioning device which is adjustable for more than one size of child.

Still another object is to provide a child positioning device which will position a child for good posture in a high-chair.

Another object of the present invention is to provide a child positioning device which will prevent the child from sliding forward in a high-chair.

Yet another object is to provide a child positioning device which may be used in various types of high-chairs.

Still another object of the present invention is to provide a child positioning device which is simple, economical to manufacture, and pleasant in appearance.

These and other objects will be apparent to those skilled in the art.

SUMMARY OF THE INVENTION

An adjustable child-positioning device is disclosed which includes an elongated cushion which is removably positioned in a high-chair. A rotatable rod, mounted longitudinally through the cushion, projects from both ends thereof, and has an adjustment member affixed on each projecting end. The adjustment member includes a pair of parallel and spaced-apart pins affixed to a base, the base being affixed to each end of the rod with one pin axial to the rod. The other pin is spaced away a distance slightly greater than the diameter of one of the frame members of the high-chair, such that the frame member will be straddled by the pins of the adjustment member of the positioning device. The cushion is placed on the chair with the pins on each side straddling a frame member, such that the cushion will raise the child's legs so that the child will not slide forward in the chair, thus maintaining a good posture. The rod is offset horizontally from the longitudinal axis of the cushion so that reversing the ends of the cushion will allow adjustment of the axis of the cushion rearwardly or forwardly in the high-chair seat. Furthermore, the adjustment member is rotatable so as to further displace the longitudinal axis of the cushion rearwardly or forwardly in the high-chair seat, thereby providing an additional amount of adjustability for the cushion.

DESCRIPTION OF THE PREFERRED EMBODIMENT

Figure 1:
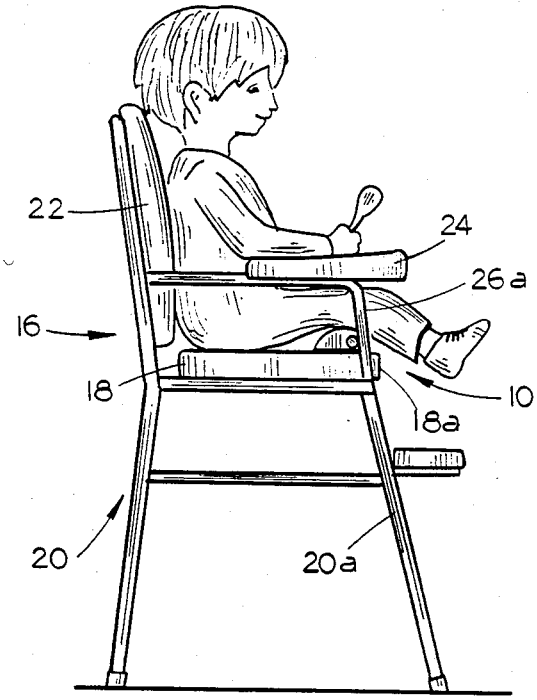
FIG. 1 is an elevational view of the child positioning device of the present invention in working position in a high-chair.
Figure 2:
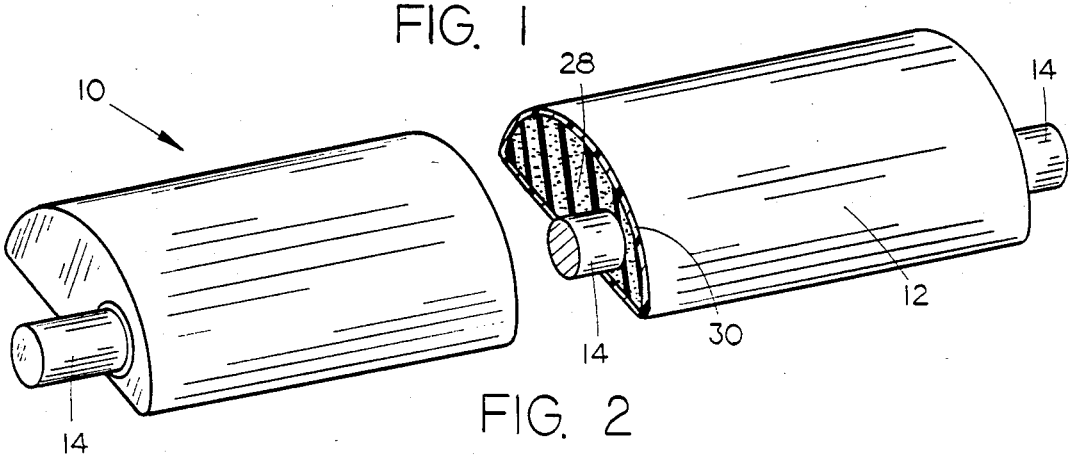
FIG. 2 is a super-enlarged, broken, perspective view of the invention.

Referring now to the drawings, in which similar or corresponding elements are identified with the same reference numeral, the child positioning device of this invention is designated generally at 10, and includes a cushion portion 12 and a rod portion 14.

High-chair 16 has a frame 20 including a left side frame 20a and a right side frame 20b (not shown). Seat 18, back 22 and optional tray 24 are connected between side frames 20*a* and 20*b*. Rod 14 of the device 10, has a length slightly greater than the side-to-side width of the seat 18 of high-chair 16. This will cause rod 14 to catch between the forward vertical members 26*a* and 26*b* (not shown) of left- and right-side frames 20*a* and 20*b* (not shown), respectively, so that it cannot be moved past the forward edge 18*a* of the high-chair seat 18.

Figure 3:
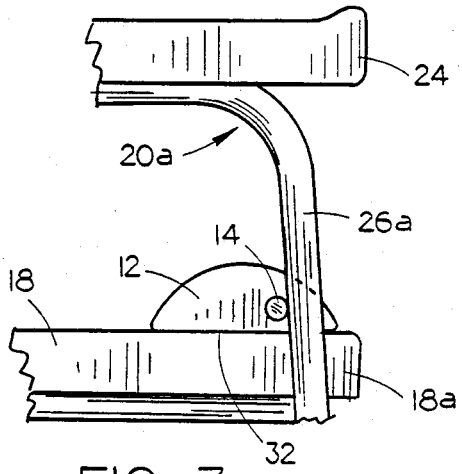
FIG. 3 is an enlarged view of a portion of FIG. 1.
Figure 4:
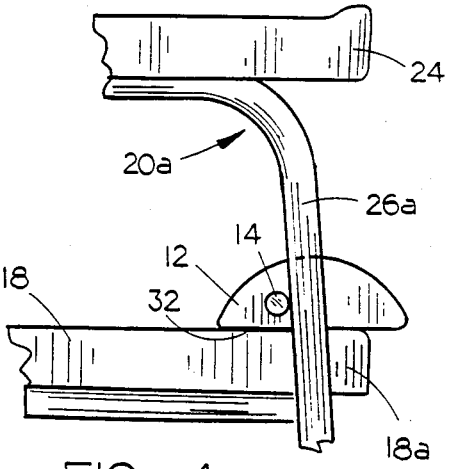
FIG. 4 is an enlarged view, similar to FIG. 3, but with the invention reversed in the chair.

Cushion 12 has a length generally equal to the width of seat 18, so that rod 14 alone will hold the cushion 12 in position. Rod 14 is mounted within cushion 12 in a position offset generally horizontally and parallel to the longitudinal axis of cushion 12. In this way, the relative position of cushion 12 on seat 18 can be adjusted by reversing the ends of rod 14 in the side-frames 20*a* and 20*b* as shown in FIGS. 3 and 4. This, in effect, will locate the longitudinal axis of cushion 12 either forwardly or rearwardly of rod 14, in relation to seat 18. Thus, the device 10 is adjustable for a larger or smaller child.

Cushion 12 is formed of a generally flexible and resilient material 28 covered with a soft flexible cover 30. The inventors presently utilize a sponge rubber material covered with vinyl. Although it is recommended that soft, sponge-like materials be used for the comfort of the child, any material which will raise the legs of the child is within the scope of the invention.

The cushion 12 has a generally semi-circular cross-section, with the flat portion 32 positioned against the seat 18 of the high-chair 16. This keeps the device 10 from moving, once in position on high-chair seat 18. While many shapes for the cushion 12 are possible with the invention, the inventors have found that a flat bottom is preferable, in order to keep the device 10 from rolling or moving once positioned in high-chair 16. This makes it much easier to lift the child into the chair 16 without having to hold or move the device 10.

In operation, the device 10 is located in a position which will lie under a child's knees when the child is seated in a high-chair 16, as shown in FIG. 1. In this way, the child cannot pull himself forward in the chair 16, since his legs are slightly lifted. Also, the child will not slide forward, since there is something to push against with the legs.

The device 10 is placed in the desired position on the chair 16 with rod ends 14 projecting beyond the seat 18 so as to catch the vertical members 26*a* and 26*b* (not shown). For smaller children, the device 10 is placed with the longitudinal axis of the cushion 12 rearward of the rod 14 (see FIG. 3); and for larger children the cushion 12 is placed with its longitudinal axis forward of rod 14 (see FIG. 4).

In a second embodiment of the invention, identified generally at 110 in FIGS. 5–11, the child positioning device 110 includes a cushion portion 112, a rod portion 114, and a rotatable adjustment member 116 mounted on each end of rod 14.

Figure 5:
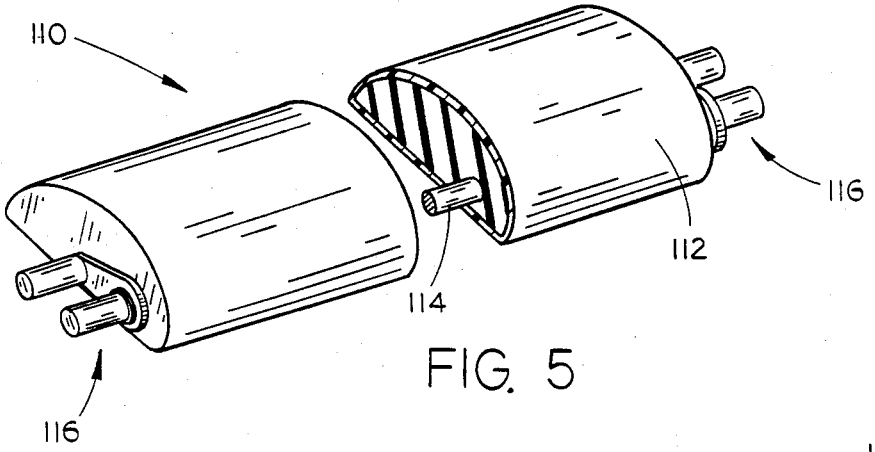
FIG. 5 is a broken, perspective view of a second embodiment of the invention.
Figure 6:
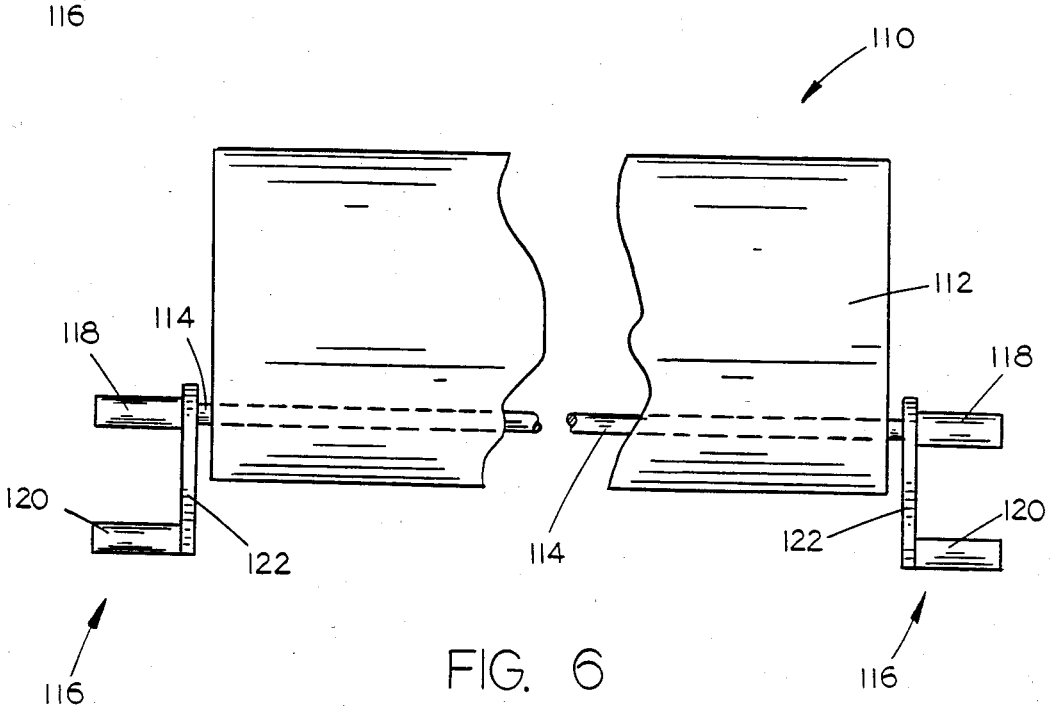
FIG. 6 is a top view of the embodiment of FIG. 5.
Figure 7:
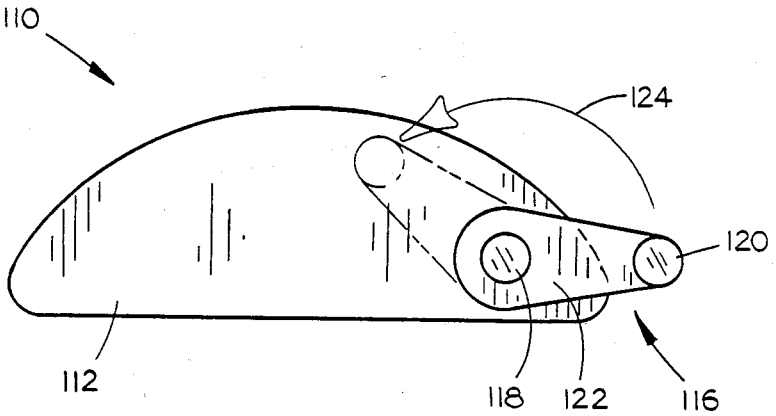
FIG. 7 is an end elevational view of the embodiment of FIG. 5.

Referring now to FIGS. 5–7, adjustment member 116 includes an axis pin 118 and an outer pin 120 mounted in spaced-apart parallel relation on a base member 122. Each base member 122 is mounted to one end of rod 114 with axis pin 118 axial to rod 114. Rod 114 is rotatable within cushion 112 such that each outer pin 120 is rotatable about axis pin 118, as shown by arrow 124 in FIG. 7.

Axis pin 118 and outer pin 120 are spaced apart a distance slightly greater than the diameter of the vertical member 26*a* of the high-chair frame 20. In this way, pins 118 and 120 of adjustment member 116 will straddle the high-chair frame so as to hold cushion 112 in place.

Figure 8:
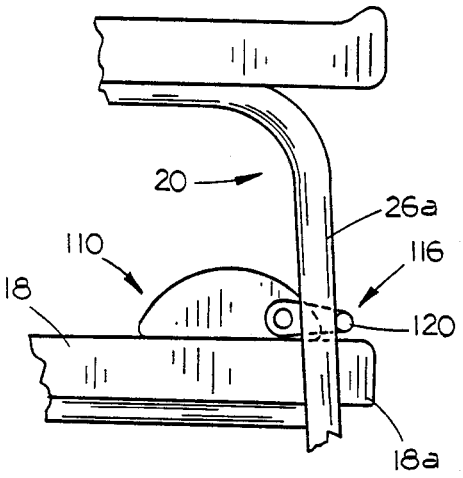
FIG. 8 is a side elevational view of the embodiment of FIG. 5, showing the invention in a working position in a high-chair.
Figure 9:
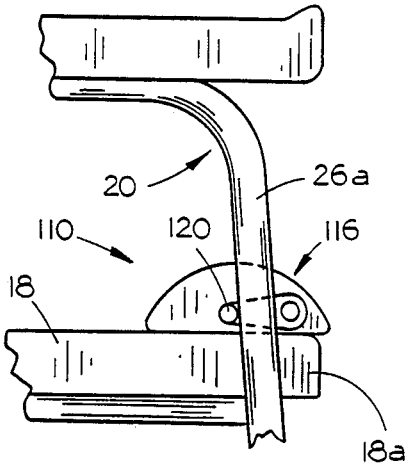
FIG. 9 is a side elevational view showing the invention in an adjusted working position in a high-chair.

Referring now to FIGS. 8–11, the adjustability of device 110 is demonstrated. In FIG. 8, a very small child will be positioned in a high-chair with good posture because device 110 may be located back from the front edge 18*a* of the chair. By rotating member 116 so that outer pin 120 is in a position reverse of that shown in FIG. 8, device 110 is moved forward in seat 18 of the chair, as shown in FIG. 9.

Figure 10:
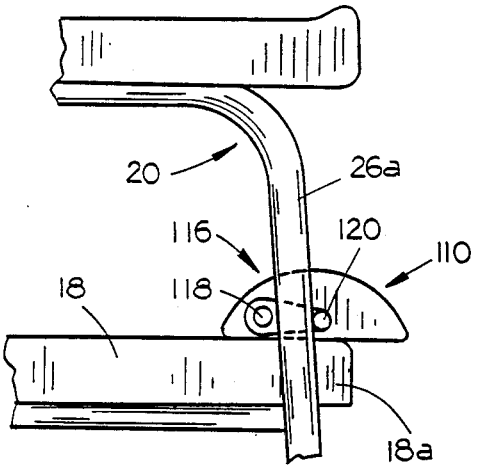
FIG. 10 is a side elevational view showing the invention in yet another working position in a high-chair.
Figure 11:
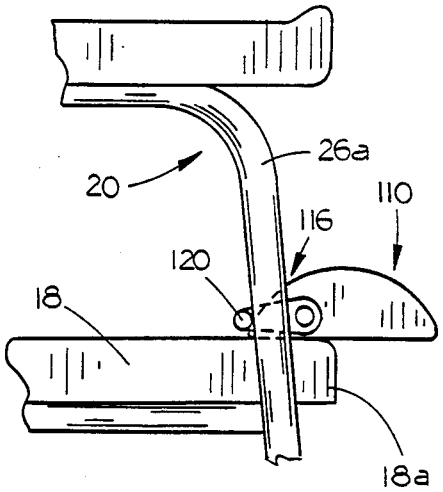
FIG. 11 is a side elevational view showing the invention in still another working position in a high-chair.

In FIG. 10, the device 110 has been reversed in the chair so that the longitudinal axis of the cushion is forward of the pivotal axis of pin 118. The adjustment member 116 may again be reversed, such that device 110 is in its forward-most position on seat 18, as shown in FIG. 11.

It can therefore be seen that adjustment member 116 enables device 110 to be utilized with a wide variety of different ages of children, without requiring complicated or numerous components to effect the adjustability necessary.

It can therefore be seen that the invention fulfills at least all of the above-stated objectives.

I claim:

1. An adjustable device for positioning a child in a high-chair, comprising:

an elongated cushion for placement under the legs of a child on the seat of a high-chair;

a rotatable rod means extending longitudinally through said cushion and projecting out of each end thereof; and means on said rod means for adjustably restraining said cushion from moving towards the forward edge of the seat of a high-chair.

2. The device of claim 1, wherein said means for adjustably restraining said cushion comprises:

a base member mounted on each end of said rod means and adapted to rotate therewith; and a pair of parallel, spaced-apart pins mounted on each of said base members and projecting outwardly therefrom parallel to said rod means.

3. The device of claim 2, wherein one said pin on each said base member is axial to said rod means.

4. The device of claim 2, wherein said pins on each said base member are spaced apart a distance adapted to straddle a side frame member of a high-chair frame.

5. The device of claim 1, wherein said rod means is mounted parallel to and offset from the longitudinal axis of said cushion.

6. The device of claim 5, wherein said rod means is offset generally horizontally from the longitudinal axis of said cushion.

7. The device of claim 1, wherein said cushion has a generally flattened bottom portion, whereby said cushion is not easily rolled to when in place on a high-chair seat.

8. The device of claim 1, wherein said cushion has a curved upper surface.

9. The device of claim 1, wherein said cushion includes a sponge-like material core with a soft material covering.

10. In combination:

a high-chair, including left and right side frames, a seat fixed between said side frames and having forward, side, and rearward edges, a back, and arm portions, said arm portions having a forward vertical member adjacent the forward edge of said seat;

a removable elongated cushion positioned on said seat with its longitudinal axis oriented laterally thereon;

a rotatable rod means extending longitudinally through said cushion and projecting out of each end thereof; and means on said rod means for adjustably restraining said cushion from moving towards the forward edge of the seat of said high-chair.

11. The device of claim 10, wherein said means for adjustably restraining said cushion comprises:

a base member mounted on each end of said rod means and adapted to rotate therewith; and a pair of parallel, spaced-apart pins mounted on each of said base members and projecting outwardly therefrom parallel to said rod means.

12. The device of claim 11, wherein one said pin on each said base member is axial to said rod means.

13. The device of claim 11, wherein said pins on each said base member are spaced apart a distance adapted to straddle a side frame member of a high-chair frame.

* * * * *